US007026751B2

(12) United States Patent
Ueda et al.

(10) Patent No.: US 7,026,751 B2
(45) Date of Patent: Apr. 11, 2006

(54) MATERIAL FOR SHADOW MASK, METHOD FOR PRODUCTION THEREOF, SHADOW MASK COMPRISING THE MATERIAL AND PICTURE TUBE USING THE SHADOW MASK

(75) Inventors: Toshiyuki Ueda, Kudamatsu (JP); Naomi Yabuta, Kudamatsu (JP); Shinichi Aoki, Kudamatsu (JP)

(73) Assignee: Toyo Kohan Co., Ltd., Tokyo (JP)

( * ) Notice: Subject to any disclaimer, the term of this patent is extended or adjusted under 35 U.S.C. 154(b) by 225 days.

(21) Appl. No.: 10/432,379

(22) PCT Filed: Nov. 14, 2001

(86) PCT No.: PCT/JP01/09964

§ 371 (c)(1),
(2), (4) Date: Oct. 8, 2003

(87) PCT Pub. No.: WO02/42509

PCT Pub. Date: May 30, 2002

(65) Prior Publication Data

US 2004/0066129 A1 Apr. 8, 2004

(30) Foreign Application Priority Data

Nov. 21, 2000 (JP) ..... 2000-354284

(51) Int. Cl.
*H01J 29/80* (2006.01)

(52) U.S. Cl. ..... 313/402; 313/407

(58) Field of Classification Search ..... 313/402, 313/407

See application file for complete search history.

(56) References Cited

FOREIGN PATENT DOCUMENTS

| | | |
|---|---|---|
| JP | 55-138027 A | 10/1980 |
| JP | 11-323500 A | 11/1999 |

OTHER PUBLICATIONS

NKK Corp, "Steel Sheet for TV Mask Frame" Abstract of JP11-323500 A (Nov. 26, 1999).

Nippon Kokan KK (JP) Nippon Mining Co Ltd. (JP), "Manufacture of Cold-Rolled Steel Sheet for Shadow Mask" Abstract of JP55-138027 A (Oct. 28, 1980).

*Primary Examiner*—Joseph Williams

(74) *Attorney, Agent, or Firm*—Browdy and Neimark, PLLC

(57) ABSTRACT

A material for a shadow mask, characterized in that it has a chemical composition: C=0.0030 wt %, Si=0.03 wt %, Mn: 0.1 to 0.5 wt %, P=0.02 wt %, S=0.02 wt %, Al: 0.01 to 0.07 wt %, N=0.0030 wt %, B: an amount satisfying $0.5 \leqq B/N \leqq 2$, and balance: Fe and inevitable impurities, and can form a shadow mask having a coercive force Hc of 90 A/m or less; and a method for producing the material, characterized in that use is made of a raw material having the above chemical composition, the finishing temperature in hot rolling is lower than Ar3 point by O to 30° C., the coiling temperature is 650 to 700° C., and the rolling reduction percentage in the final rolling (secondary cold rolling) is 30 to 45%. The material produced by the method exhibits magnetic characteristics being uniform in a coil and excellent as described above.

4 Claims, No Drawings

MATERIAL FOR SHADOW MASK, METHOD FOR PRODUCTION THEREOF, SHADOW MASK COMPRISING THE MATERIAL AND PICTURE TUBE USING THE SHADOW MASK

TECHNICAL FIELD

The present invention relates to a material for shadow masks to be in color picture tubes, a method for producing it, a shadow mask made of the material, and a picture tube comprising the shadow mask.

BACKGROUND ART

For the material for shadow masks, cold-rolled sheet steel has heretofore been produced according to a process mentioned below. Specifically, low-carbon steel manufactured by steel manufacturers is subjected to finish hot-rolling at a finishing temperature not lower than the Ar3 transformation point thereof, then washed with acid and cold-rolled into a sheet having a predetermined thickness. Next, this is degreased, then subjected to decarburizing annealing in a wet atmosphere in a box-type annealing furnace, and optionally subjected to secondary cold-rolling to a reduction ratio of at least 50% so as to make it have a thickness of final products.

The cold-rolled sheet steel produced according to this process is photo-etched by etching workers, and then annealed for softening it and thereafter pressed to make it have a predetermined shape by pressing workers. Next, this is annealed in an oxidizing atmosphere for forming an oxide film, or that is, a so-called blackened film on its surface to thereby prevent it from rusting and to reduce its radiation ratio. One important characteristic that the sheet steel is desired to have is soft magnetism. Along with the inner shield therein, the shadow mask in TV Braun tubes acts to protect the linear motion of electron beams from the external magnetic field in the environment such as geomagnetism (this is hereinafter referred to as environmental magnetic field), and therefore it must be readily magnetized by itself in the environmental magnetic field. In addition, when the direction of TV is changed, the shadow mask is magnetized in the same direction in accordance with the environmental magnetic field, and therefore, it is desirable that the demagnetizability of the shadow mask is good. To satisfy the desired soft magnetic characteristics, it is desirable that the shadow mask material has a small value of coercive force (hereinafter this is simply referred to as Hc).

For reducing the coercive force of the shadow mask material, it is desirable to coarsen the crystal grains of the material. However, coarsening the crystal grains of the conventional shadow mask material is limited, and Hc of the material is from 103 to 135 A/m or so though depending on the annealing temperature thereof. The material does not satisfy the above-mentioned requirements.

Given that situation, an object of the present invention is to provide a shadow mask material which is superior to the conventional shadow mask material in point of the soft magnetism, especially having a remarkably lowered Hc to satisfy the ultra-soft magnetism necessary for shadow masks, and to provide a method for producing the material, a shadow mask and a picture tube.

DISCLOSURE OF THE INVENTION

The material for shadow masks of the invention that solves the above-mentioned problems is characterized in that it contains N≦0.0030% by weight and B to satisfy 0.5≦B/N≦2 with a balance of Fe and inevitable impurities and it forms a shadow mask having a coercive force of at most 90 A/m.

More preferably, the material for shadow masks of the invention contains C≦0.0030% by weight, Si≦0.03% by weight, Mn of from 0.1 to 0.5% by weight, P≦0.02% by weight, S≦0.02% by weight, Al of from 0.01 to 0.07% by weight, N≦0.0030% by weight and B to satisfy 0.5≦B/N≦2 with a balance of Fe and inevitable impurities and it forms a shadow mask having a coercive force of at most 90 A/m.

One method for producing the material for shadow masks of the invention is characterized in that a steel ingot that contains N≦0.0030% by weight and B to satisfy 0.5≦B/N≦2 with a balance of Fe and inevitable impurities is hot-rolled at a finishing temperature lower than the Ar3 point thereof by from 0 to 30° C., coiled at a coiling temperature of from 540 to 700° C., washed with acid, cold-rolled and then continuously annealed to make it have a remaining C amount of at most 0.0015% by weight.

Another method for producing the material for shadow masks of the invention that solves the above-mentioned problems is characterized in that a steel ingot that contains C≦0.0030% by weight, Si≦0.03% by weight, Mn of from 0.1 to 0.5% by weight, P≦0.02% by weight, S≦0.02% by weight, Al of from 0.01 to 0.07% by weight, N≦0.0030% by weight and B to satisfy 0.5≦B/N≦2 with a balance of Fe and inevitable impurities is hot-rolled at a finishing temperature lower than the Ar3 point thereof by from 0 to 30° C., coiled at a coiling temperature of from 540 to 700° C., pickled, cold-rolled, and then continuously annealed to make it have a remaining C amount of at most 0.0015% by weight, and thereafter subjected to secondary rolling to a reduction ratio of from 30 to 45%.

The shadow mask of the invention is characterized in that it uses the above-mentioned shadow mask and is an ultra-thin shadow mask having a coercive force of at most 90 A/m and a thickness of from 0.05 to 0.25 mm; and the picture tube of the invention is characterized in that it comprises the above-mentioned shadow mask.

BEST MODES OF CARRYING OUT THE INVENTION

Preferably, the hot-rolled sheet steel to be the material for shadow masks in the embodiments of the invention is formed of a steel ingot that contains N≦0.003% by weight and B to satisfy 0.5≦B/N≦2 with a balance of Fe and inevitable impurities, and has a coercive force of at most 90 A/m.

The reasons for numerical limitations of the components are mentioned below.

Nitrogen N: N≦0.0030% by weight.

N in steel forms a nitride with Al and reduces solid solution of N, therefore reducing the aging resistance of steel. Accordingly, it is desirable that the amount of N in steel is as small as possible. For ensuring the pressability of the material for shadow masks, the amount of N must be as small as possible. Therefore, it is desirable that the uppermost limit of N is 0.0030% by weight. More preferably, it is at most 0.0020% by weight.

Boron B: 0.5≦B/N≦2, more preferably 0.8≦B/N≦1.2.

B in steel acts to coarsen the crystal grains in thin sheet steel, and is therefore effective for making steel have good magnetic characteristics favorable for shadow mask materials. Especially in ultra-thin shadow masks having a thickness of from 0.08 mm to 0.25 mm or so that are used these days, the effect of B is remarkable. In addition, since B in steel is effective for fixing solid solution of N, it is desirable to add B to steel for use in the invention. On the other hand, however, too much B will fine down the crystal grains of steel and will detract from the magnetic characteristics of steel. Therefore, it is desirable that the B content of steel is defined to fall within a predetermined range. From that viewpoint, the amount of B is preferably so selected in relation to N that it satisfies $0.5 \leqq B/N \leqq 2$, more preferably $0.8 \leqq B/N \leqq 1.2$.

Coercive force Hc: $Hc \leqq 90$ A/m.

In order to obtain shadow masks of better demagnetizability than conventional shadow masks having a coercive force of from 103 to 135 A/m, it is desirable that the coercive force of the material for shadow masks is at most 90 A/m.

Further in the invention, it is desirable to use a steel ingot having the composition mentioned below for the material of hot-rolled sheet steel. The steel ingot of the type is preferred for the material of ultra-thin shadow masks which are used these days and have a thickness of from 0.08 mm to 0.25 mm or so.

Specifically, the composition of the steel ingot contains $C \leqq 0.0030\%$ by weight, $Si \leqq 0.03\%$ by weight, Mn of from 0.1 to 0.5% by weight, $P \leqq 0.02\%$ by weight, $S \leqq 0.02\%$ by weight, and Al of from 0.01 to 0.07% by weight. The reasons for the numerical limitation of the individual components are mentioned below.

Carbon C: $C \leqq 0.0030\%$ by weight.

The amount of C in hot-rolled sheet steel has a significant influence on the continuous annealing process of decarburizing the steel. If it is higher than 0.0030% by weight, then the steel could not be well decarburized in the process of continuously annealing it. If so, the annealing temperature must be elevated and the annealing time must be prolonged in order that the remaining C content of the shadow mask material could be at most 0.0015% by weight, preferably at most 0.0008% by weight, and it increases the production costs and lower the productivity. Accordingly, it is desirable that the uppermost limit of the C content is 0.0030% by weight. Preferably, the C content is at most 0.0025% by weight, more preferably at most 0.0020% by weight.

Silicon Si: $Si \leqq 0.03\%$ by weight.

Si in the shadow mask material is an element that is against the blackening operation in fabricating picture tubes, and its amount is preferably as small as possible. However, Si is an inevitable element in Al killed steel, and it is desirable that its uppermost limit is 0.03% by weight. Preferably, it is at most 0.025% by weight, more preferably at most 0.02% by weight.

Manganese Mn: from 0.1 to 0.5% by weight.

Mn in hot-rolled sheet steel is a component that is necessary for preventing the steel from undergoing red shortness by an impurity S during hot rolling. Therefore, since the material for ultra-thin shadow masks to which the invention is directed is often cracked during cold rolling, it is desirable that a predetermined amount of Mn is positively added to it. For the effect, the amount of the element is preferably at least 0.1% by weight, more preferably at least 0.25% by weight. However, if its amount is over 0.6%, the component will worsen the shapability of steel. Therefore, its amount is preferably at most 0.5% by weight, more preferably at most 0.40% by weight, even more preferably at most 0.35% by weight.

Phosphorus $P \leqq 0.02\%$ by weight.

P in the shadow mask material acts to fine down the crystal grains therein and therefore worsens the magnetic characteristics of the material. Accordingly, its amount is preferably as small as possible. In particular, the influence of P on the material for ultra-thin shadow masks of the invention is significant. Therefore, P is preferably at most 0.02% by weight.

Sulfur $S \leqq 0.02\%$ by weight.

S in hot-rolled sheet steel is an inevitable element, and it is an impurity that causes red shortness during hot rolling. Its amount is preferably as small as possible. Since the material for ultra-thin shadow masks of the invention is often cracked during cold rolling, it is desirable to positively remove S from it. To that effect, the amount of S is preferably at most 0.02% by weight, more preferably at most 0.01% by weight.

Aluminum Al: from 0.01 to 0.07% by weight.

Al in hot-rolled sheet steel is one that is added to steel bath as a deoxidizing agent and is removed from it as slag. However, if its amount is too small, it could not exhibit stable deoxidation. To that effect, its amount is preferably at least 0.01% by weight, more preferably at least 0.02% by weight. However, even if its amount is over 0.07% by weight, its effect could no more increase. Since the crystal grains of steel for use in the invention are preferably coarse, it is undesirable to add too much Al to steel since it will fine down the crystal grains. Therefore, the amount of Al is preferably at most 0.07% by weight, more preferably at most 0.04% by weight.

Balance: Fe and inevitable impurities.

Fe, and inevitable elements that are in the material not detracting from the etchability and the pressability of the material are not limited.

Next described is the method for producing the material for ultra-thin shadow masks of the invention. Regarding the condition of heating the slab, if the heating temperature of the slab is lower than 1100° C., the hot rollability of the slab is not good. For surely hot-rolling the slab, it is desirable that the heating temperature is higher than 1100° C. On the other hand, if the slab-heating temperature is too high, AlN in the slab will completely dissolve and will form fine crystal grains in the hot-rolled sheet steel, and the magnetic characteristics of the sheet steel will be bad. Specifically, Hc of the sheet steel increases. Accordingly, it is desirable that the slab-heating temperature is not higher than 1250° C.

If the finishing temperature in hot rolling is higher than the Ar3 point of the steel, the steel will undergo $\gamma \rightarrow \alpha$ transformation after finish rolling. Therefore, fine crystal grains will be formed in the finished steel to worsen the magnetic characteristics of the steel. Specifically, Hc of the steel increases. Accordingly, the $\gamma \rightarrow \alpha$ transformation shall be finished before finish rolling, or that is, the $\gamma \rightarrow \alpha$ transformation shall not occur after finish rolling to coiling up. Therefore, the finishing temperature in hot rolling is lower than the Ar3 point of the steel by from 0 to 30° C., preferably by from 10 to 20° C. The coiling temperature preferably falls between 540 and 700° C. in view of the quality stability in the coil width direction and the machine direction in hot rolling, but more preferably between 650 and 700° C. for enlarging the crystal grains in the hot-rolled sheet steel. The uppermost limit of the coiling temperature is not limited from the magnetic characteristics of the steel, but is 700° C. from the scale removability in the step of washing the steel with acid. The lowermost limit of the temperature is 540° C. or higher in view of the Hc of the steel.

(Steps of Pickling, Primary and Secondary Cold Rolling)

Pickling and primary cold rolling may be effected under ordinary conditions. For efficiently decarburizing and annealing the ultra-thin shadow mask material of the invention, it is desirable that the thickness of the primary cold-rolled sheet steel is at most 0.6 mm. For reducing the Hc of the sheet steel, the secondary rolling reduction shall be from 30 to 45%. The lowermost limit of the secondary rolling reduction is not specifically defined from the magnetic characteristics of the sheet steel, but shall be at least 30% in view of the mechanical characteristics of the sheet steel products. Concretely, users of the products desire that the tensile strength of the sheet steel is at least 500 MPa. To satisfy it, the secondary rolling reduction in producing the sheet steel is at least 30%. The thickness of the primary-rolled sheet steel will be at least 0.42 mm, preferably at lest 0.38 mm, considering that the product thickness is from 0.08 to 0.25 mm.

(Continuous Annealing Step)

Continuous annealing is an important step in the invention where steel is subjected to decarburizing annealing. For the continuous annealing, preferably, the sheet temperature is not lower than 750° C., the soaking time is 60 seconds or longer, the annealing atmosphere comprises from 0 to 75% by weight of hydrogen gas with a balance of nitrogen gas, and the dew point is from −30 to 70° C.

(Annealing Temperature)

The annealing temperature has a significant influence on the decarburization efficiency and the magnetic characteristics of the processed steel. If it is lower than 750° C., the decarburization will take a lot of time and the productivity will be poor, and, in addition, the recrystallized texture of the annealed steel is uneven and the steel could not have uniform magnetic characteristics. Accordingly, the annealing temperature is preferably not lower than 750° C., more preferably not lower than 800° C. The uppermost limit of the annealing temperature may be 850° C. in view of the durability of the apparatus.

(Annealing Time)

Preferably, the annealing time is not shorter than 60 seconds. If it is shorter than 60 seconds, the sheet steel could not be satisfactorily decarburized enough for the material for ultra-thin shadow masks, and it will be difficult to make the material have the intended C content of not larger than 0.0015%. It is unnecessary to specifically define the uppermost limit of the annealing time, but the time is preferably not longer than 180 seconds in view of the productivity and for preventing the formation of too coarse grains in the sheet steel.

(Hydrogen Concentration in Continuous Annealing Atmosphere, and Dew Point)

When the hydrogen concentration in the continuous annealing atmosphere is kept at most 70%, then the C content of the ultra-thin shadow mask material could be at most 0.0015%. Even if the hydrogen concentration therein is higher than 70%, it could not have any influence on the decarburization time, but would rather increase the production costs. Therefore, it is desirable that the uppermost limit of the hydrogen concentration is 70%. When the dew point falls between −35 and 70° C., then the C content of the ultra-thin shadow mask material could be at most 0.0015%.

(Secondary Cold-rolling Step After Annealing)

It is a matter of importance that the rolling reduction in the secondary cold rolling step after the annealing is from 30 to 45% in order that the Hc of the sheet steel could be at most 90 A/m. If the rolling reduction is smaller than 30%, the tensile strength, one mechanical property of the sheet steel will be smaller than 500 MPa and the mechanical strength of the steel will be poor; but if larger than 45%, the Hc of the steel will increase.

EXAMPLES

The invention is described in more detail with reference to the following Examples. The steel ingots having the chemical compositions of Example 1 to Example 5 shown in Table 1 were hot rolled under the condition shown in Table 2 into hot-rolled sheet steel of 2.3 mm thick. These were pickled and then cold-rolled into sheets having a thickness of 0.3 mm. Next, these were continuously annealed under the condition shown in Table 2 for decarburization. The annealing temperature was 800° C. The process gave shadow mask materials of Examples 1 to 5. Similarly but for comparison, the steel ingots having the chemical compositions of Comparative Examples 1 to 6 in Table 1 were hot-rolled and annealed under the conditions shown in Table 2 to prepare sheet steel samples of Comparative Examples 1 to 6. Further, these were cold-rolled into ultra-thin shadow mask materials having a thickness of 0.25 mm.

The mechanical characteristic and the magnetic characteristic of the shadow mask materials of Examples and Comparative Examples obtained in the manner as above were measured to evaluate the materials. The results are given in Table 3.

For the mechanical characteristic, the tensile strength (abbreviated as T.S.) of JIS #5 sample pieces of each material was measured. In Table 3, O indicates the material having a tensile strength of at least 500 MPa, and x indicates the material having a tensile strength of lower than 500 MPa.

Next, the magnetic characteristic of the shadow mask materials obtained herein was evaluated as follows: The shadow mask materials were again annealed, and the Hc thereof, one important parameter of magnetic characteristics was measured in the manner mentioned below to evaluate the magnetic characteristic of the materials.

TABLE 1

Chemical Compositions of Steel Ingots

| Example or Comparative Example | Chemical Composition (wt %) | | | | | | | | |
|---|---|---|---|---|---|---|---|---|---|
| | C | Si | Mn | P | S | Al | N | B | B/N |
| Example 1 | 0.0022 | 0.01 | 0.10 | 0.006 | 0.005 | 0.059 | 0.0030 | 0.0021 | 0.89 |
| Example 2 | 0.0023 | 0.01 | 0.10 | 0.006 | 0.005 | 0.059 | 0.0030 | 0.0021 | 0.89 |
| Example 3 | 0.0028 | 0.02 | 0.24 | 0.009 | 0.008 | 0.063 | 0.0021 | 0.0031 | 1.88 |
| Example 4 | 0.0028 | 0.02 | 0.24 | 0.009 | 0.008 | 0.063 | 0.0021 | 0.0031 | 1.88 |
| Example 5 | 0.0028 | 0.02 | 0.24 | 0.009 | 0.008 | 0.063 | 0.0021 | 0.0031 | 1.88 |
| Comp. Ex. 1 | 0.0022 | 0.01 | 0.10 | 0.006 | 0.005 | 0.059 | 0.0030 | 0.0021 | 0.89 |
| Comp. Ex. 2 | 0.0023 | 0.01 | 0.10 | 0.006 | 0.005 | 0.059 | 0.0030 | 0.0021 | 0.89 |
| Comp. Ex. 3 | 0.0022 | 0.01 | 0.10 | 0.006 | 0.005 | 0.059 | 0.0030 | 0.0021 | 0.89 |
| Comp. Ex. 4 | 0.0023 | 0.01 | 0.10 | 0.006 | 0.005 | 0.059 | 0.0030 | 0.0021 | 0.89 |

TABLE 1-continued

Chemical Compositions of Steel Ingots

| Example or Comparative Example | Chemical Composition (wt %) | | | | | | | | |
|---|---|---|---|---|---|---|---|---|---|
| | C | Si | Mn | P | S | Al | N | B | B/N |
| Comp. Ex. 5 | 0.0022 | 0.01 | 0.10 | 0.006 | 0.005 | 0.059 | 0.0030 | 0.0021 | 0.89 |
| Comp. Ex. 6 | 0.0023 | 0.01 | 0.10 | 0.006 | 0.005 | 0.059 | 0.0030 | 0.0021 | 0.89 |

TABLE 2

Conditions in Producing Materials

| Example or Comparative Example | Hot-Rolling Condition | | Annealing | | Secondary Rolling Reduction | C after annealing (wt %) |
|---|---|---|---|---|---|---|
| | Finishing Temperature (° C.) | Coiling Temperature (° C.) | System | Annealing Temperature | | |
| Example 1 | 870 | 670 | continuous annealing | 800° C. | 42% | 0.0008 |
| Example 2 | 860 | 670 | continuous annealing | 800° C. | 42% | 0.0008 |
| Example 3 | 870 | 670 | continuous annealing | 800° C. | 42% | 0.0011 |
| Example 4 | 870 | 670 | continuous annealing | 800° C. | 38% | 0.0011 |
| Example 5 | 850 | 650 | continuous annealing | 800° C. | 42% | 0.0011 |
| Comp. Ex. 1 | 840 | 670 | continuous annealing | 800° C. | 42% | 0.0008 |
| Comp. Ex. 2 | 900 | 670 | continuous annealing | 800° C. | 42% | 0.0008 |
| Comp. Ex. 3 | 860 | 500 | continuous annealing | 800° C. | 42% | 0.0008 |
| Comp. Ex. 4 | 860 | 670 | continuous annealing | 800° C. | 25% | 0.0008 |
| Comp. Ex. 5 | 870 | 670 | continuous annealing | 800° C. | 60% | 0.0008 |
| Comp. Ex. 6 | 870 | 710 | continuous annealing | 800° C. | 42% | 0.0008 |

The annealing condition was as follows: The sheet steel was annealed at two different temperatures, 725° C. and 830° C. each for 10 minutes. The atmosphere was comprised of 5.5% by weight of hydrogen with a balance of nitrogen gas. The dew point was 10° C. Hc of each sample sheet was obtained according to a tetrode Esptein's method. In Table 3, O indicates the sample having a magnetic characteristic Hc of smaller than 90 A/m; and x indicates the sample having Hc of 90 A/m or more. The descalability was evaluated as follows: The samples were dipped in a 30 wt. % $H_2SO_4$ solution for 30 seconds, and visually checked for scale. x indicates the sample with scale; and O indicates the sample with no scale.

TABLE 3

Results of Characteristic Evaluation

| Example or Comparative Example | Mechanical Characteristic (T.S.) (MPa) | Magnetic Characteristic 725° C. Hc (A/m) | Magnetic Characteristic 830° C. Hc (A/m) | Evaluation: Mechanical Characteristic (T.S.) | Evaluation: Magnetic Characteristic (Hc) | Evaluation: Descalability |
|---|---|---|---|---|---|---|
| Example 1 | 530 | 85 | 83 | ○ | ○ | ○ |
| Example 2 | 532 | 86 | 84 | ○ | ○ | ○ |
| Example 3 | 541 | 87 | 88 | ○ | ○ | ○ |
| Example 4 | 542 | 88 | 87 | ○ | ○ | ○ |
| Example 5 | 509 | 82 | 82 | ○ | ○ | ○ |
| Comp. Ex. 1 | 533 | 94 | 94 | ○ | X | ○ |
| Comp. Ex. 2 | 540 | 92 | 90 | ○ | X | ○ |
| Comp. Ex. 3 | 560 | 94 | 93 | ○ | X | ○ |
| Comp. Ex. 4 | 420 | 78 | 78 | X | ○ | ○ |

TABLE 3-continued

| Results of Characteristic Evaluation | | | | | | |
|---|---|---|---|---|---|---|
| | Mechanical | Magnetic Characteristic | | Evaluation | | |
| Example or Comparative Example | Characteristic (T.S.) (MPa) | 725° C. Hc (A/m) | 830° C. Hc (A/m) | Mechanical Characteristic (T.S.) | Magnetic Characteristic (Hc) | Descalability |
| Comp. Ex. 5 | 610 | 95 | 94 | ○ | X | ○ |
| Comp. Ex. 6 | 520 | 83 | 82 | ○ | ○ | X |

The results in Table 3 obviously confirm that the materials of Examples 1 to 5 all have a coercive force Hc, one parameter of magnetic characteristics, of lower than 90 A/m under any temperature condition of 725 and 830° C. and their magnetic characteristics are favorable for shadow mask materials. In addition, it is understood that, when the pre-annealing temperature is elevated from 725° C. to 830° C., then the crystals grow into large crystal grains in the products and the magnetic characteristic (Hc) is thereby improved. The results further confirm the excellent mechanical characteristic and descalability of the materials of the invention. As opposed to these, Hc of the comparative materials is 90 A/m or more except in Comparative Example 4 and Comparative Example 6, and the comparative materials do not have the desired ultra-soft magnetic characteristic. The materials of Examples 1 and 2 of the invention are better than the materials of Comparative Examples 1 and 2 in point of the magnetic characteristic. The reason is because of the influence of the finishing temperature in rolling on the rolled sheets. In addition, they are better than the material of Comparative Example 3 also in point of the magnetic characteristic. The reason is because of the influence of the take-up temperature on the coiled sheets. The magnetic characteristic of the material of Comparative Example 4 is good, but the mechanical characteristic thereof is lower than 500 MPa. This means that users will be difficult to handle it. The materials of Examples 1 and 2 of the invention are better than the material of Comparative Example 5 in point of the magnetic characteristic (Hc). This is because of the influence of the secondary rolling reduction on the rolled sheets. The characteristics of the material of Comparative Example 6 are good, but the coiling temperature for it is high and, in addition, its descalability is not good. Therefore, this is unfavorable for industrial-scale production.

INDUSTRIAL APPLICABILITY

As described hereinabove, the present invention provides a shadow mask material which has better soft magnetic characteristics than conventional shadow mask materials, especially having a significantly lowered coercive force Hc and satisfying the soft magnetism necessary for shadow masks. In particular, the mechanical characteristics (tensile strength) of the material of the invention are good and the ultra-soft magnetic characteristics thereof are also good, and the material is favorable for ultra-thin shadow masks. The invention also provides shadow masks formed of the material, and picture tubes that comprise the shadow mask.

The invention claimed is:

1. A material for shadow masks, which is characterized in that it consists of C≦0.0030% by weight, Si≦0.03% by weight, Mn of from 0.1 to 0.5% by weight, P≦0.02% by weight, S≦0.02% by weight, Al of from 0.01 to 0.07% by weight, N≦0.0030% by weight and B to satisfy 0.5≦B/N≦2 with a balance of Fe and inevitable impurities and it forms a shadow mask having a coercive force of at most 90 A/m.

2. A method for producing a material for shadow masks, which is characterized in that a steel ingot that consists of C≦0.0030% by weight, Si≦0.03% by weight, Mn of from 0.1 to 0.5% by weight, P≦0.02% by weight, S≦0.02% by weight, Al of from 0.01 to 0.07% by weight, N≦0.0030% by weight and B to satisfy 0.5 ≦B/N≦2 with a balance of Fe and inevitable impurities is hot-rolled at a finishing temperature lower than the Ar3 point thereof by from 0 to 30° C., coiled at a take-up temperature of from 540 to 700° C., washed with acid, cold-rolled, and then continuously annealed as a temperature of not less than 750° C. to make it have a remaining C amount of at most 0.0015% by weight, and thereafter subjected to secondary rolling to a reduction ratio of from 30 to 45%.

3. A shadow mask formed of the material of claim 1, which has a coercive force of at most 90 A/m and a thickness of from 0.05 to 0.25 mm.

4. A picture tube that comprises the shadow mask of claim 3.

* * * * *